United States Patent [19]

Ga et al.

[11] 4,268,409

[45] May 19, 1981

[54] PROCESS FOR TREATING RADIOACTIVE WASTES

[75] Inventors: Eiichi Ga; Koichi Chino; Makoto Kikuchi; Akira Oda; Susumu Horiuchi, all of Hitachi, Japan

[73] Assignee: Hitachi, Ltd., Tokyo, Japan

[21] Appl. No.: 58,174

[22] Filed: Jul. 17, 1979

[30] Foreign Application Priority Data

Jul. 19, 1978 [JP] Japan ..... 53-88654
Jul. 19, 1978 [JP] Japan ..... 53-88656

[51] Int. Cl.[3] ..... G21F 9/08
[52] U.S. Cl. ..... 252/301.1 W; 264/0.5
[58] Field of Search ..... 252/301.1 W; 264/0.5

[56] References Cited

U.S. PATENT DOCUMENTS 4,033,868 7/1977 Melchsner ..... 252/301.1 W

FOREIGN PATENT DOCUMENTS 52-85700 7/1977 Japan .

52-94866 8/1977 Japan .

*Primary Examiner*—Deborah L. Kyle
*Attorney, Agent, or Firm*—Craig and Antonelli

[57] ABSTRACT

An aqueous solution containing granular ion exchange resin and filter aid as a radioactive waste generated from a nuclear power plant is supplied to the casing of a centrifugal film dryer, which comprises a casing, a rotating shaft inserted in the casing, rotating blades fixed to the rotating shaft within the casing, and a heating means for heating the wall surface of the casing. The aqueous solution flows down along the heated inside wall of the casing while the rotating shaft is rotated. Water of the aqueous solution is evaporated, while the granular ion exchange resin and the filter aid are turned into powder by the action of rotating blades in rotation. The powder is led to a pelletizer, and shaped into pellets. The pellets are filled in a drum, and asphalt is then filled in the drum. After the solidification of the asphalt, the drum is tightly sealed.

11 Claims, 8 Drawing Figures

PROCESS FOR TREATING RADIOACTIVE WASTES

BACKGROUND OF THE INVENTION

This invention relates to a process for treating radioactive wastes, and more particularly to a process for treating radioactive wastes, where pellets containing the powder of granular ion exchange resin can be shaped.

Various radioactive wastes generated from radioactive material-handling facilities in nuclear power plants, etc. are treated or stored after classification of the individual radioactive waste according to their characteristics. For example, in a power plant utilizing a boiling water type nuclear reactor, a regenerated waste solution containing sodium sulfate as a main component is evaporated and dried into powder by means of a centrifugal film drier, and then the powder shaped into pellets. The pellets are filled in a drum, and the drum is tightly sealed after the filling of asphalt into the drum (Japanese Laid-open Patent Application No. 64699/75).

Used granular ion exchange resin and used filter aid at a high radioactivity level are stored in a slurry state in a tank in a nuclear power plant. When the granular ion exchange resin and the filter aid are stored in the slurry state, a wall of the tank has a risk of corrosion. When the used granular ion exchange resin and filter aid are accumulated only in the tank with the operating time of the nuclear power plant, the tank must be large. Thus, these radioactive solid wastes are filled in drums, and solidified by cement in the drums. However, in such a treatment, it is not possible to fill a large amount of the radioactive solid wastes in the drum, and a large amount of solidified radioactive solid waste are inevitably produced.

To reduce the amount of the solidified wastes, the used granular ion exchange resin is made into powder in a centrifugal film drier in the same manner as for the regenerated waste solution, and the resulting powder is shaped into pellets (U.S. patent application Ser. No. 963,119). However, pellets cannot be obtained only by compressing the powder of granular ion exchange resin.

SUMMARY OF THE INVENTION

An object of the present invention is to shape the powder of granular ion exchange resin into pellets.

Another object of the present invention is to shape the powder of granular ion exchange resin into pellets without increasing the amount of radioactive waste to be discarded.

Another object of the present invention is to prevent breakage of pellets containing the powder of granular ion exchange resin.

A further object of the present invention is to shape pellets of mixed powder or various kinds of radioactive materials generated from radioactive material-handling facilities.

The present invention is characterized by making the granular ion exchange resin and the filter aid generated from radioactive material-handling facilities separately into the respective powders, mixing the powder of the granular ion exchange resin with the powder of the filter aid as a binder, and shaping the mixture into pellets, where a mixing ratio of the respective powders for shaping pellets is preferably such that the powder of the granular ion exchange resin is in not more than 90% by weight, the balance being the powder of the filter aid.

The present invention is further characterized by making the sodium sulfate generated from the radioactive material-handling facility into powder, mixing the powder of sodium sulfate as a binder in the two kinds of powders, that is, the powder of granular ion exchange resin and the powder of filter aid, and shaping the mixture into pellets, where preferable pellets containing X% by weight of the power of sodium sulfate, Y% by weight of the powder of granular ion exchange resin, and Z% by weight of the powder of filter aid are shaped, wherein Y and Z are obtained according to the following formulae:

$$Y = 90 - 21.8\left(\frac{X}{10}\right) + 1.6\left(\frac{X}{10}\right)^2 + 0.44\left(\frac{X}{10}\right)^3 - 0.045\left(\frac{X}{10}\right)^4$$

$$Z = 100 - (X + Y)$$

DESCRIPTION OF THE PREFERRED EMBODIMENTS

Figure 1:
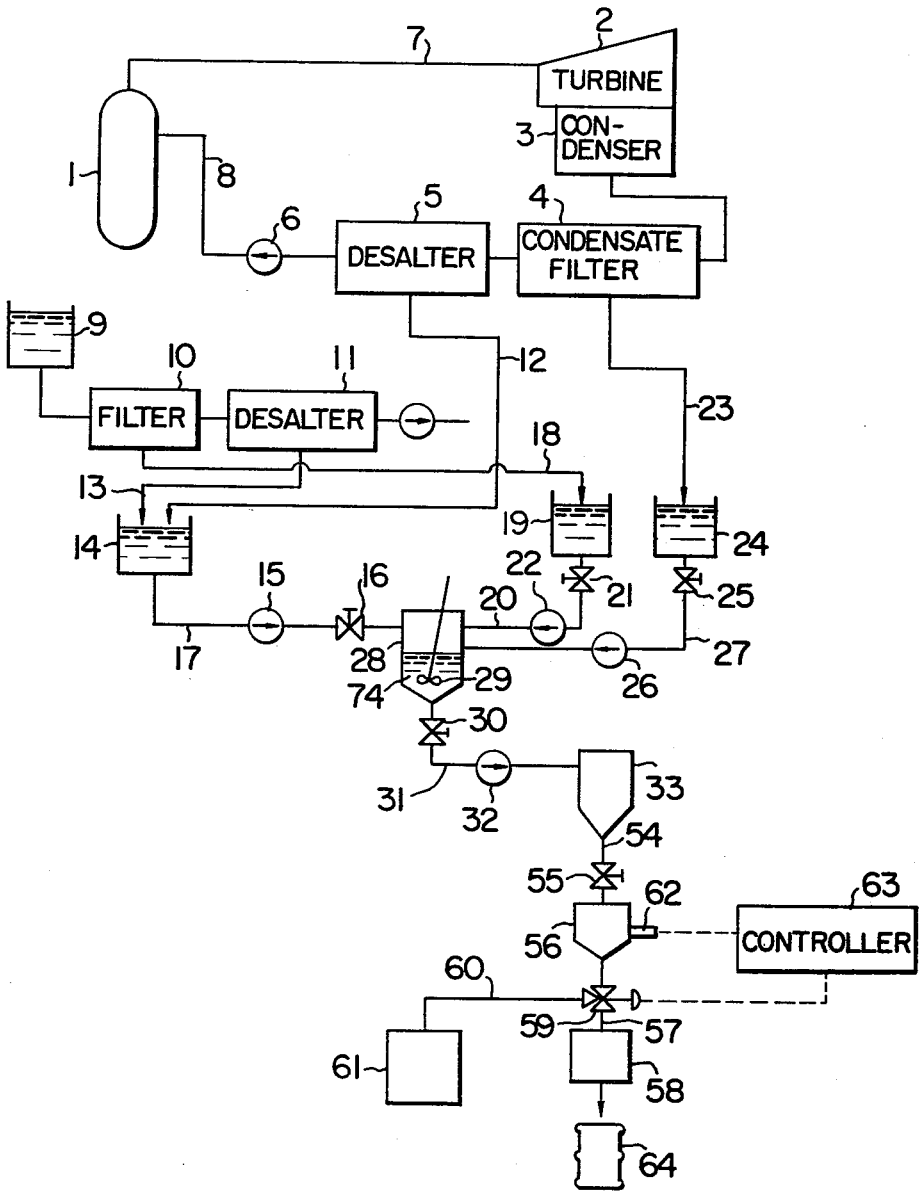
FIG. 1 is a flow diagram of an apparatus for treating radioactive wastes, to which a preferable embodiment of the present invention is applied.

The present invention has been established, in view of the difficulty of shaping pellets only from the powder of granular ion exchange resin, by experimentally confirming that the powder of granular ion exchange resin can be shaped by mixing the powder of granular ion exchange resin with the powder of filter aid.

A preferable embodiment of the present invention will be described below, referring to FIG. 1, where the present invention is applied to a power plant utilizing a boiling water-type nuclear reactor.

Steam generated in a nuclear reactor 1 is led to a turbine 2 through a main steam conduit 7, and then condensed in a condenser 3. Condensed water from the condenser 3 is separated from solid matters such as cladding, etc. by a condensate filter 4, further process to remove ions therefrom and purified by a desalter 5, pressurized by a feed water pump 6 and returned to the nuclear reactor 1 through a feed water conduit 8.

Equipment drainage generated from the power plant employing the boiling water type nuclear reactor is collected in a collector tank 9, and purified by a filter 10 and a desalter 11. The desalters 5 and 11 are connected to a tank 14 through conduits 12 and 13, respectively.

Granular ion exchange resin (particle diameter: 0.2–0.5 mm) is filled in the desalters 5 and 11. A conduit 17 connected to the tank 14 communicates with a mixing tank 28 through a slurry pump 15 and a valve 16. Filter medium precoated with cellulose (particle size: 100μ) on its surface is placed in the filter 10. The filter 10 is connected to a tank 19 through a conduit 18. A conduit 20 connected to the tank 19 is connected to the mixing tank 28 through a valve 21 and a slurry pump 22. The condensate filter in which a filter medium precoated with powdery resin (particle size: 100μ) on its surface is placed, is connected to a tank 24 through a conduit 23. The cellulose and powdery resin to be precoated on the surface of the filter medium are called "filter aid". A conduit 27 connects the tank 24 to the mixing tank 28. A valve 25 and a slurry pump 26 are provided in the conduit 27. A stirrer 29 is provided in the mixing tank 28. A conduit 31 having a valve 30 and a pump 32 connects the mixing tank 28 to a centrifugal film drier 33.

Figure 2:
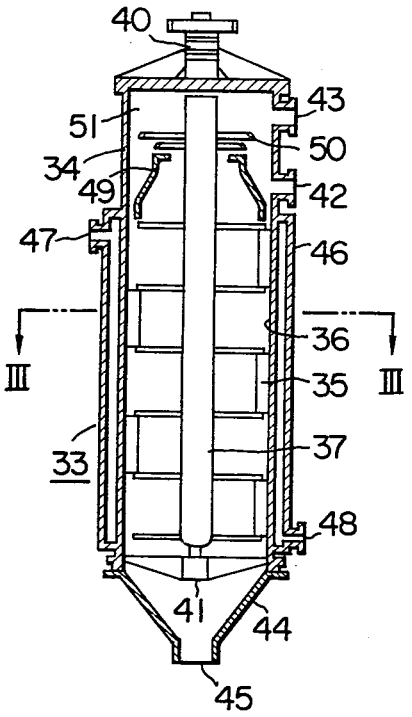
FIG. 2 is a vertical cross-sectional view of a centrifugal film drier to be used in the apparatus of FIG. 1.
Figure 3:
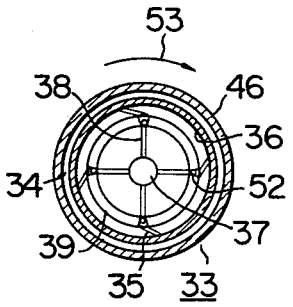
FIG. 3 is a cross-sectional view along the line III—III of FIG. 2.

Structure of the centrifugal film drier 33 will be described in detail, referring to FIGS. 2 and 3.

The centrifugal film drier 33 is provided with a rotating shaft 37 equipped with rotating blades 35 in a casing 34. The rotating shaft 37 is supported by an upper bearing 40 and a lower bearing 41. A vapor outlet 43 and a solution inlet 42 are provided at the upper part of the casing 34. The conduit 31 is connected to the solution inlet 42. A bottom cover 44 with a powder outlet 45 is provided at the lower part of the casing 34. A mist separator 50 and a distributor 49 are provided in the upper part in the casing 34 to form a vapor chamber 51. A jacket 46 is provided around the casing 34 and has a heating medium inlet 47 and a heating medium outlet 48. The rotating blades 35 are rotatably fixed, by means of pins 52, to support rings 39, which are fixed to the rotating shaft 37 by support arms 38.

A conduit 54 connected to the powder outlet 45 of the centrifugal film drier 33 connects the centrifugal film drier 33 to a hopper 56 through a valve 55. A conduit 57 connects the bottom of the hopper 56 to a pelletizer 58. A three-way valve 59 is provided in the conduit 57. One end of a conduit 60 is fixed to the three-way valve 59, and other end of the conduit 60 is connected to a tank 61. A water content detector 62 is provided at the hopper 56. Numeral 63 designates controller.

The granular ion exchange resin whose life has been expired in the desalters 5 and 11 is introduced in a slurry state into the tank 14 through the conduits 12 and 13 as used granular ion exchange resin. The powdery resin whose capacity has been lowered in the condensate filter 4 is taken off from the surface of filter medium and introduced in a slurry state into the tank 24 through the conduit 23. The cellulose whose capacity is lowered in the filter 10 is taken off from the surface of filter medium, and introduced in a slurry state into the tank 19 through the conduit 18.

A slurry of the granular ion exchange resin in the tank 14 is fed into the mixing tank 28 by opening the valve 16 and driving the slurry pump 15. The concentration of the granular ion exchange resin in the slurry is 5% by weight. When the concentration of the granular ion exchange resin is over 5% by weight, the conduit 17, etc. may be clogged. The slurry containing 5% by weight of cellulose can be supplied to the mixing tank 28 from the tank 19 by opening the valve 21 and driving the slurry pump 22. The slurry of the granular ion exchange resin and the slurry of the cellulose are fed into the mixing tank 28 at a flow rate (kg/hr) proportion of 3 for the former, and at a flow rate (kg/hr) proportion of 1 for the latter. The valve 25 is closed. Since cladding of $Fe_2O_3$ is attached to the used granular ion exchange resin and the cellulose, the radioactivity level in the tanks 14 and 19 is considerably high. That is, the radioactivity level in the tank 14 is about 9 μci/cc, and that in the tank 19 is about 12 μci/cc.

Since Co50, Mn54, etc. of high radioactivity level attach to the cladding, a radioactivity level will be increased in the centrifugal film drier 33, if the slurry solution is fed into the centrifugal film drier 33 together with the cladding. This is a factor of making a maintenance and an inspection of the centrifugal film drier 33 very difficult.

Before the respective slurries are introduced into the mixing tank 28, claddings are removed from the slurries. Claddings attached to the granular ion exchange resin and the cellulose are separated therefrom by applying an ultrasonic wave thereto and the cladding is removed by an electromagnetic filter, though not shown in the drawings. The radioactivity level of the granular ion exchange resin slurry to be introduced into the mixing tank 28 is lowered down to about 0.3 μci/cc by such pretreatment, and that of the cellulose slurry down to about 0.6 μci/cc.

Slurry 74 containing the used granular ion exchange resin and cellulose as radioactive materials (which will be hereinafter referred to merely as "solution") is stirred in the mixing tank 28 by means of the stirrer 29, and then is fed into the casing of the centrifugal film drier 33 from the solution inlet 42 through the conduit 31 by opening the valve 30 and by driving the pump 32. Concentration of the solid matters in the solution 74 is 5% by weight.

The solution 74 is uniformly distributed to the peripheral direction by the distributor 49 and flows down along the inner surface of the casing 34 by gravity. The descending solution 74 is pressed in a thin film state against the inner surface of the casing 34 by a centrifugal force attained by the action of the rotating blades 35 by rotating the rotating shaft 37. Steam at 165° C. is supplied into an annular space formed between the casing 34 and the jacket 46 from the heating medium inlet, and flows out of the heating medium outlet 48. The wall surface of the casing 34 surrounded by the jacket 46 is heated by steam, and serves as a heat transfer surface 36. As the solution 74 flows down along the heat transfer surface 36 (the temperature of the steam in the annular space between the casing 34 and the jacket 46 is 155° C.), water is evaporated. The resulting vapor flows out at the vapor outlet 43 through the vapor chamber 51.

Since the rotating blades 35 are rotatably fixed to the support arms 31 by means of the pins 52, tip ends of the rotating blades move in the direction of arrow 53 while being pressed against the heat transfer surface 36 by the centrifugal force when the rotating shaft 37 is made to rotate in the direction of arrow 53. The used granular ion exchange resin and cellulose in the solution are pulverized by the movement of the rotating blades 35 in the direction of arrow 53.

Mixed powder of the two kinds of radioactive materials, that is, the powder of the granular ion exchange resin (particle size: about 150μ) and the powder of the cellulose (particle sizes: about 50μ) is withdrawn from the centrifugal film drier 33 at the powder outlet 45. The pulverization of the respective radioactive materials is carried out by rubbing between the heated heat transfer surface 36 and the tip ends of the rotating blades 35. Even when the inner wall temperature of the heat transfer surface 36 is above 80° C., the respective radioactive materials can be made into powder. The powder of the granular ion exchange resin and the powder of the cellulose are more uniformly mixed together by revolution of the rotating shaft 30.

The mixed powder is led to the hopper 56. The mixed powder in the hopper 56 is subjected to measurement of water content by means of the water content detector 62. When the water content of the mixed powder is below the set value, the three-way valve 59 is operated by the action of the controller 63 to connect the hopper 56 to the pelletizer 58. A valve is provided in the conduit 57 at the downstream side of the three-way valve 59, though not shown in the drawing, and the valve is also opened. The mixed powder is introduced into the pelletizer 58 from the hopper 56, and shaped into pellets in the pelletizer 56. The pellets are filled in a vessel of metallic wire mesh (not shown in the drawing) placed in the drum 64, as disclosed in Japanese Laid-open Patent Application No. 85700/77. After the filling of pellets, asphalt is poured into the drum. After the solidification of asphalt, the drum 64 is tightly sealed, and a solidified mass of the radioactive wastes is obtained thereby. A volume of the solidified mass is reduced to one-fifth by pulverizing the granular ion exchange resin and cellulose, and pelletizing the resulting powder, as shown in the foregoing embodiment.

When the water content of the powder in the hopper is above the set value, the hopper 56 is connected to the conduit 61 by means of the three-way valve 59 operated by the controller 63, and the powder in the hopper 56 is discharged into the tank 61.

After the discharge of the powder from the hopper 56, and washing and drying in the hopper 56 have been completed, the centrifugal film drier 33 is again operated to produce mixed powder.

According to the embodiment described above, the powder of granular ion exchange resin can be easily made into pellets, since the powder of cellulose is mixed into the powder of granular ion exchange resin. Furthermore, since the granular ion exchange resin and cellulose, though different in kind, can be pulverized in a single treating facility, that is, in the centrifugal film drier 33, the facilities for treating the radioactive wastes can be considerably simplified. Furthermore, the treatment of the individual radioactive wastes can be simplified. Since various radioactive wastes generated from a power plant utilizing a boiling water-type nuclear reactor are pulverized and shaped into pellets, a considerable reduction in volume of the waste can be attained, as described above. This means that a volume of the radioactive wastes generated from the power plant utilizing the boiling water-type nuclear reactor can be considerably reduced.

When a mixing ratio of the powder of granular ion exchange resin to the powder of cellulose is changed to various degrees and pellets are shaped from the resulting mixture, it is found impossible to shape pellets, if the amount of granular ion exchange resin is larger than 90% by weight on the basis of the pellets. Thus, it is necessary for shaping the powder of granular ion exchange resin into pellets to keep the powder of granular ion exchange resin to not more than 90% by weight. The powder of cellulose as the filter aid acts as a kind of binder for shaping the powder of granular ion exchange resin into pellets.

The slurry of granular ion exchange resin and the slurry of cellulose to be introduced into the mixing tank 28 have concentrations of 5% by weight each, and thus the flow rate (kg/hr) of the slurry of granular ion exchange resin to be introduced into the mixing tank 28 must be not more than 9 times the flow rate (kg/hr) of the slurry of cellulose.

Figure 4:
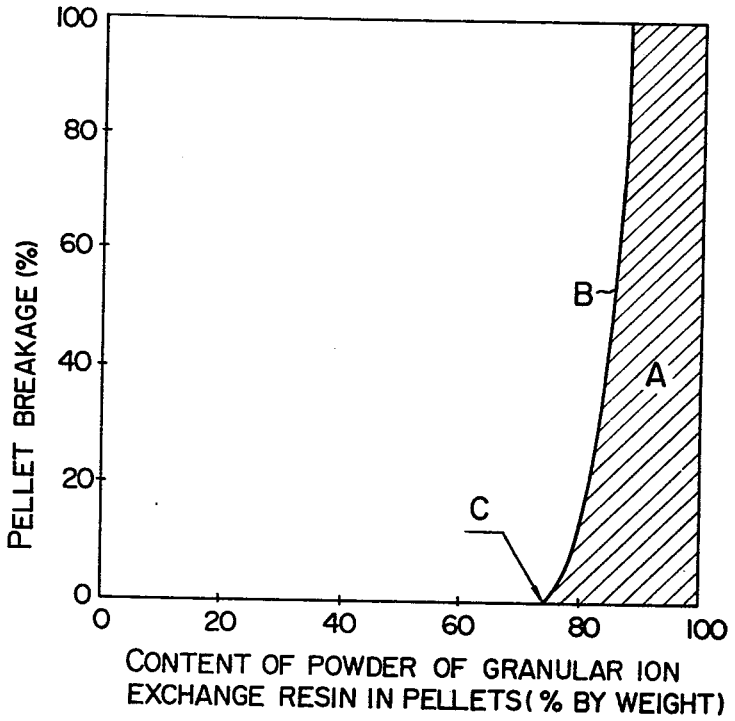
FIG. 4 is a characteristic diagram showing the relationship between the content of the powder of granular ion exchange resin in pellets and percent pellet breakage.

Since the pellets are made to fall into the drum 64 from the pelletizer 58, a strength large enough to withstand a breakage by falling into the drum is required for the pellets. The height from the pellet discharge outlet of the pelletizer 58 to the bottom of the vessel of metallic wire mesh in the drum 64 is about 2 m, and a state of breakage of pellets is investigated by making the pellets fall down from the height of 3 m including a safety factor. The results are shown in FIG. 4. That is, FIG. 4 shows experimental results of preparing various pellets by changing the mixing ratio of the powder of granular ion exchange resin to the powder of cellulose, and making the pellets fall down onto a concrete floor surface from the height of 3 m. In FIG. 4, an area A with slanted lines at the right side of curve B is an area where the pellets are broken. When not more than 78% by weight of the powder of granular ion exchange resin is contained in the pellets, that is, when the cellulose content is about 22% by weight, no breakage of pellets takes place. The pellets containing more than 78% by weight of the powder of granular ion exchange resin (right side of point C in FIG. 4) are broken, and the percent of pellet breakage is rapidly increased with increasing content of the powder of granular ion exchange resin, as shown by curve B. To prevent the breakage of pellets by falling, the content of the powder of granular ion exchange resin in pellets must be not more than 78% by weight (left side of point C in FIG. 4).

Even when the granular ion exchange resin is mixed with the powdery resin in place of the cellulose, the resulting mixture is fed to the centrifugal film drier 33 to pulverize these resins, and the powders are shaped into pellets, similar effects to those of the foregoing embodiment can be obtained.

That is, in FIG. 1, the valve 21 is closed, and the valve 25 is opened and the slurry pump 26 is operated, whereby the slurry of powdery resin containing 5% by weight of the powdery resin is fed into the mixing tank 28. Since the cladding is attached to the powdery resin, and thus the radioactivity level is about 12 μci/cc, the slurry of powdery resin must be led into the mixing tank 28 after the cladding has been removed from the resin in the same manner as for the cellulose. The radioactivity level after the removal of cladding is lowered down to about 0.6 μci/cc. Flow rate (kg/hr) proportion of the slurry of granular ion exchange resin and that of the slurry of powdery resin led into the mixing tank 28 are 3 and 1, respectively. The respective slurries are mixed together by means of the stirrer 29. The resulting mixed slurry of the granular ion exchange resin and the powdery resin is fed into the centrifugal film drier 33. The granular ion exchange resin and the powdery resin are made into powders (particle size of the powder of the former: about 150μ and that of the latter: about 23μ) by operating the centrifugal film drier 33, as described above. The powders are shaped into pellets, and then solidified by asphalt in the drum 64.

When the powder of granular ion exchange resin is mixed with the powder of powdery resin, pellets can be shaped by keeping the content of the powder of granular ion exchange resin to not more than 90% by weight and breakage of the pellets by falling can be prevented by keeping the content of the powder of granular ion exchange resin to not more than 78% wy weight, as in the mixing with the powder of cellulose.

The slurry of cellulose and the slurry of powdery resin can be supplied to the mixing tank 28 at the same time by opening the valves 21 and 25. In that case, proportions of flow rates (kg/hr) of the respective slurrier to be supplied to the mixing tank 28 must be such that that of the slurry of granular ion exchange resin is not more than 9, and that of sum total of the slurry of cellulose and the slurry of powdery resin is more than 1.

The slurry of granular ion exchange resin and the slurry of cellulose can be supplied to one centrifugal film drier 33 simultaneously but separately without mixing them. Even in that case, uniformly mixed powder can be obtained by revolution of the rotating shaft 37.

In the embodiment shown in FIG. 1, the granular ion exchange resin, cellulose, etc. are fed in a mixed state into the centrifugal film drier 33, but they can be made separately into individual powders by the centrifugal film drier, and these powders can be mixed together, supplied to the pelletizer, and shaped into pellets. One centrifugal film drier can be provided each for a specific use of pulverizing the respective materials, that is, the granular ion exchange resin and the cellulose, or alone for a common use of pulverizing these materials. In the latter case, it is necessary to control switching of the valves so that both granular ion exchange resin and cellulose cannot be fed into the centrifugal film drier at the same time. In this embodiment, similar effects to those of the embodiment shown in FIG. 1 can be obtained, but the apparatus for treating the wastes will be more complicated than that for the embodiment of FIG. 1. Furthermore, an apparatus for mixing two kinds of powders is required, and a possibility of uneven mixing may be brought about. It is needless to say that said embodiment is also applicable to the use of the powdery resin, etc. in place of the cellulose.

Another embodiment of the present invention will be described, referring to FIG. 5. Same members as in the structure of FIG. 1 are represented by the same symbols. In the present embodiment, an apparatus 66 for water-resisting treatment is provided at the downstream side of the pelletizer 58.

Only different parts from those of the embodiment of FIG. 1 will be described below:

The apparatus 66 for water-resistant treatment comprises a tank 67, and a belt conveyor 68 provided as inclined in the tank 67. A water-resisting agent 69 is filled in the tank 67. The shaped pellets 72 are supplied onto the belt conveyor 68 under the liquid level of the water-resisting agent 69. Thus, the surfaces of the pellets 72 are coated with the water-resisting agent 69. The pellets 72 on the belt conveyor 68 move upwards by rotating the belt coriveyor 68 in the direction of arrow 73, and fall down into a hopper 70. Then, the pellets 72 are filled into a vessel of metallic wire mesh in the drum 64 through a conduit 71. Then, asphalt is poured into the drum 64. In the present embodiment, effects similar to those of the embodiment of FIG. 1 can be obtained, and furthermore disintegration of the pellets 72 due to absorption water in the air before the pouring of asphalt can be prevented.

In order to increase a binding force between the powders in the pellets, a binder can be added to the solution 74 or the powder obtained from the centrifugal film drier. The possibility of disintegration of the pellets due to absorption of water in the air can be also reduced thereby. However, the addition of the binder correspondingly increases the ultimate volume of the radioactive wastes.

Figure 5:
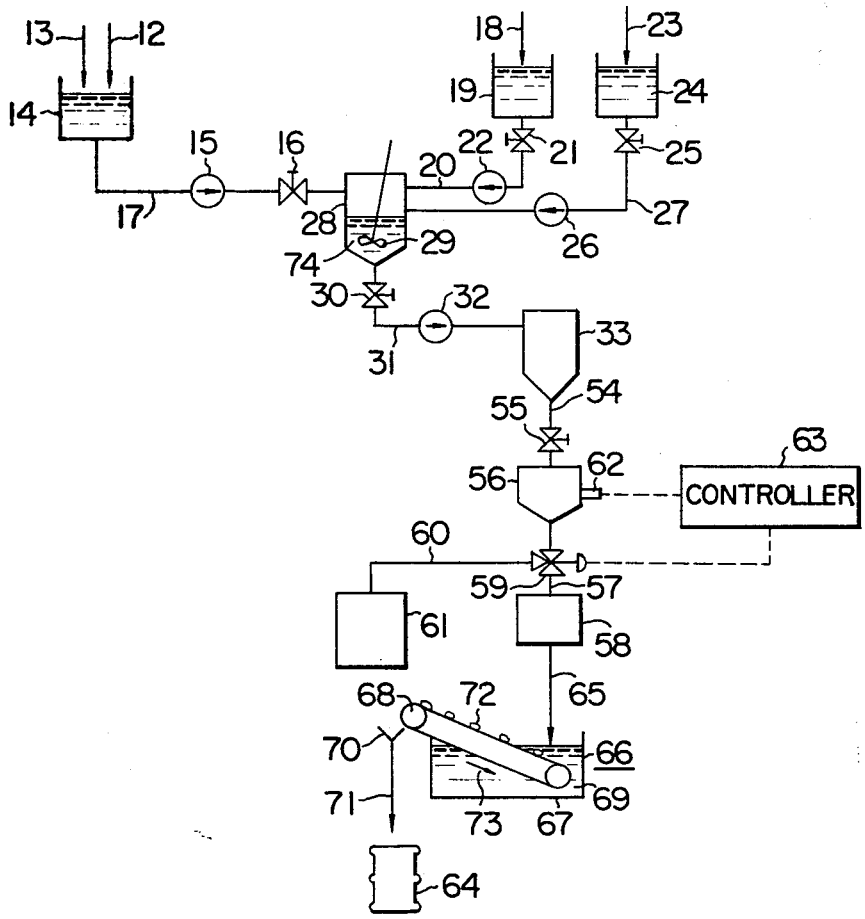
FIG. 5 is a flow diagram showing another embodiment of the apparatus for treating radioactive wastes.

The embodiments shown in FIGS. 1 and 5 can be applied to shaping the used granular ion exchange resin, cellulose and powdery resin generated from a power plant employing a pressurized water-type nuclear reactor, a power plant employing a heavy water nuclear reactor, and a nuclear fuel-reprocessing plant into pellets.

Figure 6:
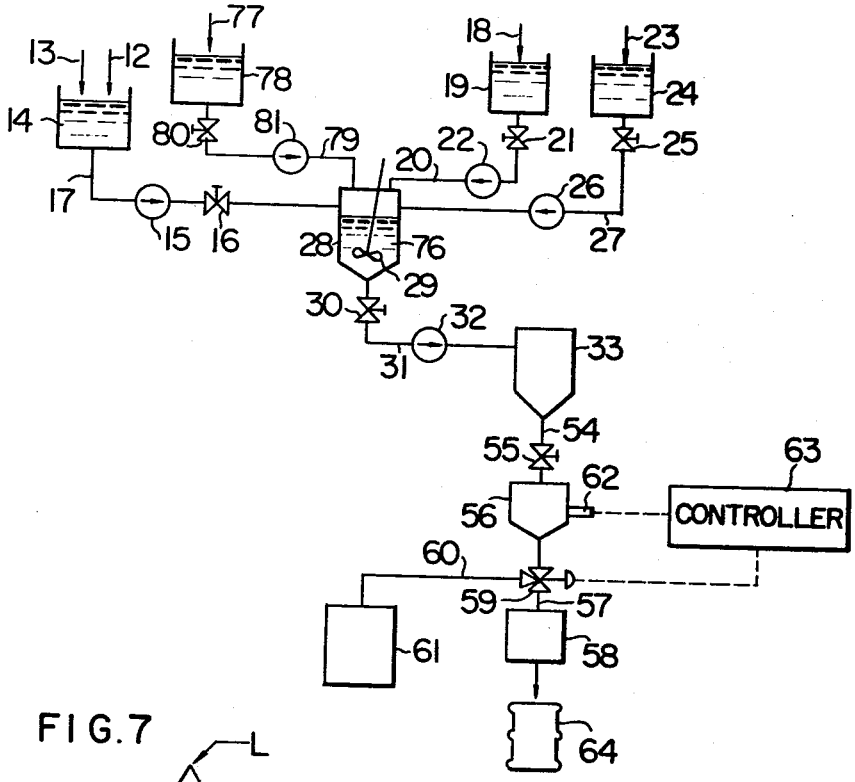
FIG. 6 is a flow diagram showing another embodiment of the apparatus for treating radioactive wastes.

Another embodiment of the present invention is shown in FIG. 6. Same members as those of the embodiment of FIG. 1 are represented by the same symbols, and only different parts from those of the embodiment of FIG. 1 will be described.

The present embodiment is applied also to the power plant employing the boiling water-type nuclear reactor.

A tank 78 communicates with the mixing tank 28 through a conduit 79, and a valve 80 and a pump 81 are provided in the conduit 79.

When the capacity of the granular ion exchange resin in the desalters 5 and 11 is lowered, the granular ion exchange resin is regenerated. The granular ion exchange resin in the desalters 5 and 11 is a mixture of cationic ion exchange resin and anionic ion exchange resin. When the granular ion exchange resin is to be regenerated, the granular ion exchange resin is withdrawn from the desalters 5 and 11, and separated into the cationic ion exchange resin and the anionic ion exchange resin, and the individual ion exchange resins are separately regenerated. The cationic ion exchange resin is regenerated by sulfuric acid, whereas the anionic ion exchange resin is regenerated by sodium hydroxide. The waste sulfuric acid solution and waste sodium hydroxide solution resulting from these regenerating operations are mixed together, whereby a waste solution containing sodium sulfate as a main component is obtained.

The waste solution is concentrated in a concentrating apparatus (not shown in the drawing) and then is led to the tank 78 through a conduit 77. The concentrated waste solution in the tank 78 contains about 20% by weight of sodium sulfate, and sodium sulfate is dissolved in the concentrated waste solution.

The slurry of granular ion exchange resin (concentration of granular ion exchange resin: 5% by weight), the slurry of cellulose (concentration of cellulose: 5% by weight), and the concentrated waste solution are introduced into the mixing tank 28 by opening the valves 16, 21 and 80, and driving the slurry pumps 15 and 22, and the pump 81. The mixed waste solution 76 (which will be hereinafter referred to as "solution") in the mixing tank 28 is mixed by rotating the stirrer 29. Proportions of flow rates (kg/hr) of the slurry of granular ion exchange resin, the slurry of cellulose and the concentrated waste solution to be led to the mixing tank 28 are 1 for the slurry of granular ion exchange resin, 1 for the slurry of cellulose, and 5 for the concentrated waste solution. The content of solid matters in the solution 76 is repressed to not more than 5% by weight. The valve 25 is closed.

The solution 76 in the mixing tank 28 is fed into the casing 34 of the centrifugal film drier 33 at the solution inlet 42 through the conduit 31 by opening the valve 30 and driving the pump 32. A ratio of the granular ion exchange resin to the sum total of the granular ion exchange resin, cellulose and sodium sulfate in the solution 76 is 4.5% by weight. Similarly, the ratio of cellulose thereto is 4.5% by weight, and the ratio of sodium sulfate thereto 91% by weight.

The three components in the solution 76 are made into powder by heating the heat transfer surface 36 of the centrifugal film drier 33 and revolving the rotating shaft 37 in the same manner as for the embodiment of FIG. 1, and the resulting powder is withdrawn from the centrifugal film drier 33. The powder of a mixture of said three components is led to the hopper 56 and then to the pelletizer 58 and shaped into pellets therein, and then the pellets are filled in a vessel of metallic wire mesh in the drum 64. Asphalt is poured into the drum 64, and after the solidification of the asphalt, the drum 64 is tightly sealed.

According to the present embodiment, the powder of the mixture of the granular ion exchange resin, cellulose and sodium sulfate can be easily shaped into pellets. Since three different kinds of radioactive wastes can be pulverized in a single treating facility, that is, in the centrifugal film drier 33, the facilities for treating the radioactive wastes can be considerably simplified. Furthermore, the individual treatments of radioactive wastes can be simplified. Since the various radioactive wastes generated from the power plant utilizing the boiling water-type nuclear reactor can be pulverized and shaped into pellets, a considerable reduction in volume can be attained. This means that the volume of the radioactive wastes generated from the power plant utilizing the boiling water-type nuclear reactor can be considerably reduced.

Figure 7:
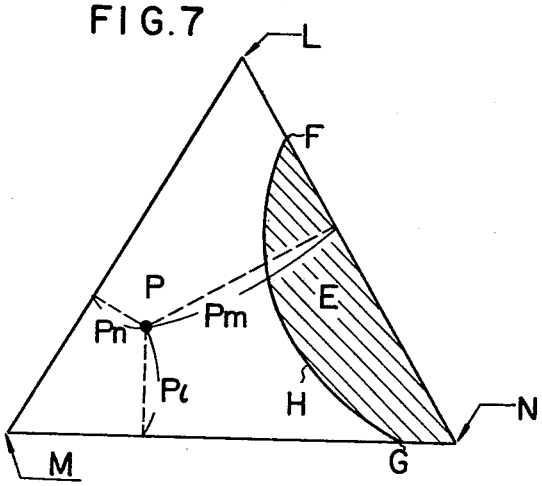
FIG. 7 is a characteristic diagram showing a pellet-shapable mixing ratio when granular ion exchange resin, cellulose and sodium sulfate are mixed together.

Experimental results of a range for shaping pellets when a mixing ratio of the granular ion exchange resin, cellulose and sodium sulfate is changed to various degrees are shown in FIG. 7. When the granular ion exchange resin, cellulose and sodium sulfate are allotted individually to the respective axes of rectangular coordinates of three dimensions, sum total of these three allotments becomes 100% by weight, and thus the respective test points are on the same plane. FIG. 7 shows this plane, on which the point L represents shapability of single sodium sulfate, that is, at 100% by weight, into pellets, the point M that of single cellulose, and the point N that of the powder of single granular ion exchange resin.

Proportions of lengths in perpendiculars to the respective sides of an equilateral triangle ABC from any point P within the equilateral triangle ABC, that is, a perpendicular P1 to a straight line MN from the point P, a perpendicular Pm to a straight line LN from the point P, and a perpendicular Pn to a straight line LM from the point P correspond to the proportions of the respective components in the pellets. That is, the pellets having a composition of point P contain three components in a ratio of (the powder of sodium sulfate): (the powder of cellulose): (the powder of granular ion exchange resin) = P1: Pm: Pn, where the sum total of P1, Pm and Pn becomes 100% by weight. The area with slanted lines in FIG. 7 is an area where the pellets cannot be shaped. Curve H indicates a boundary between the pellet-shapable area and the pellet-unshapable area. Suppose that the content of the powder of granular ion exchange resin in the pellets is Y% by weight, that of the powder of sodium sulfate X% by weight, and that of the powder of cellulose is Z% by weight, the content Y of the powder of granular ion exchange resin on the curve H can be represented by the following formula (1):

$$Y = 90 - 21.8\left(\frac{X}{10}\right) + 1.6\left(\frac{X}{10}\right)^2 + 0.44\left(\frac{X}{10}\right)^3 - 0.045\left(\frac{X}{10}\right)^4 \quad (1)$$

The content Z of the powder of cellulose on the curve H can be represented by the following formula (2):

$$Z = 100 - (X + Y) \quad (2)$$

The pellets at point F contain 80% by weight of the powder of sodium sulfate and 20% by weight of the powder of granular ion exchange resin. The pellets at point G contain 90% by weight of the powder of granular ion exchange resin and 10% by weight of the powder of cellulose. Thus, when the powder of sodium sulfate, the powder of cellulose and the powder of granular ion exchange resin are mixed together and shaped into pellets, the content Y of the powder of granular ion exchange resin in the pellets must be in the range shown by the following formula (3):

$$Y \leqq 90 - 21.8\left(\frac{X}{10}\right) + 1.6\left(\frac{X}{10}\right)^2 + 0.44\left(\frac{X}{10}\right)^3 - 0.045\left(\frac{X}{10}\right)^4 \quad (3)$$

Three different kinds of radioactive wastes can be fed to the centrifugal film driers 33 and pulverized separately into the individual powders, which are stored separately in the individual hoppers. Then, the powder of granular ion exchange resin, the powder of cellulose and the powder of sodium sulfate in the respective hoppers can be mixed in a mixing tank and the resulting mixed powder can be supplied into the pelletizer, and shaped into pellets. One centrifugal film drier can be provided each for a specific use of pulverizing the respective materials, or alone for a common use of pulverizing these materials. In the latter case, it is necessary to control switching of the valves so that the granular ion exchange resin, cellulose and sodium sulfate cannot be fed into the centrifugal film drier at the same time. In the present embodiment, similar effects to those of the embodiment shown in FIG. 6 can be obtained, but the apparatus for treating the wastes will be more complicated than that for the embodiment of FIG. 6. Furthermore, it takes much labor and time to carry out uniform mixing of the three kinds of the powders.

Similar effects to those of the embodiment shown in FIG. 6 can be obtained by closing the valve 21, opening the valve 25, and supplying the powdery resin as the filter aid in place of the cellulose to the mixing tank 28. The condition of formula (3) is also applicable to the case using the powdery resin. Both cellulose and powdery resin can be also supplied to the mixing tank 28 in the apparatus of FIG. 6.

Figure 8:
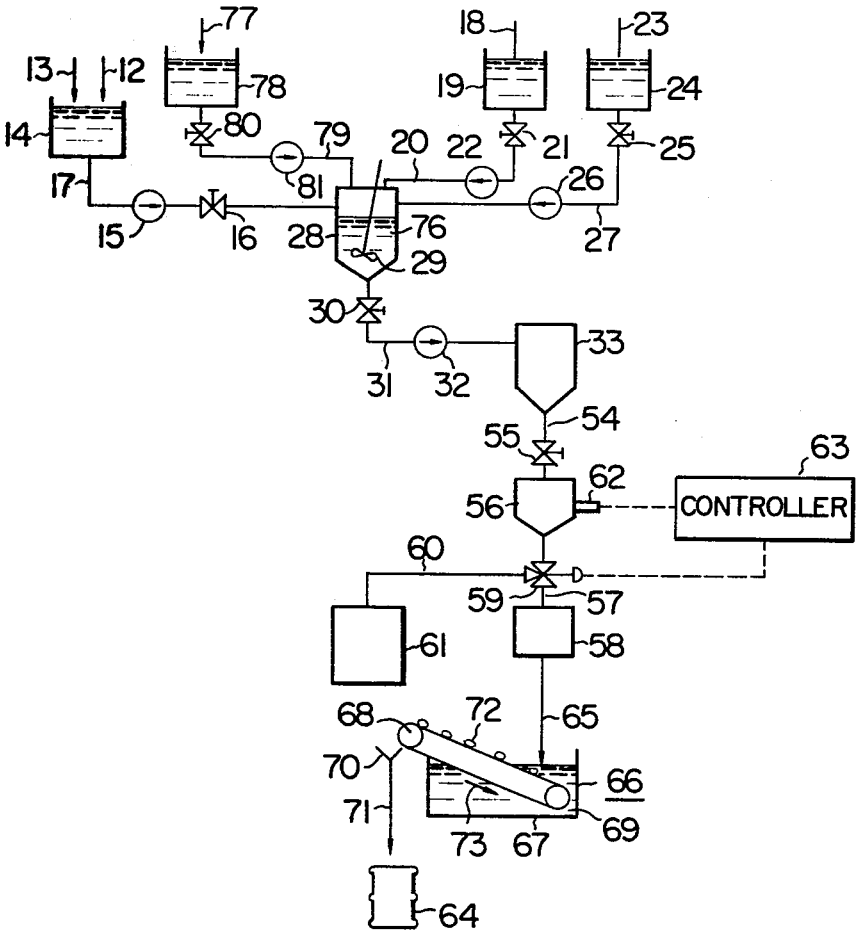
FIG. 8 is a flow diagram showing a further embodiment of the apparatus for treating the radioactive wastes.

Another embodiment of the present invention is shown in FIG. 8, where the pellets shaped in the pelletizer 58 according to the embodiment of FIG. 6 are supplied to the apparatus 66 for water-resistant treatment shown in FIG. 5. The surfaces of the pellets 72 are coated by the water-resistant agent 69, and the disintegration of pellets 72 due to the absorption of water can be prevented, as in the embodiment of FIG. 5, in addition to the effects obtained in the embodiment of FIG. 6.

According to the present invention, other radioactive wastes generated from the radioactive material-handling facilities than the granular ion exchange resin can be used as a binder, whereby the granular ion exchange resin can be easily made into pellets. Thus, the volume of the radioactive wastes generated from the radioactive material-handling facilities can be considerably reduced. Furthermore, since no other materials not generated from the radioactive material-handling facilities are used as the binder, the volume of the radioactive wastes is never increased.

We claim:

1. A process for treating radioactive wastes, which comprises:

a step of heating a first slurry containing granular ion exchange resin as a radioactive waste generated from a radioactive material-handling facility, thereby making the granular ion exchange resin into powder;

a step of heating a second slurry containing a filter aid as a radioactive waste generated from said radioactive material-handling facility, thereby making the filter aid into powder;

a step of obtaining mixed powder of the powder of the granular ion exchange resin and the powder of the filter aid as a binder, a ratio of the powder of the granular ion exchange resin to the mixed powder being not more than 90% by weight; and a step of shaping the mixed powder into pellets.

2. A process according to claim 1, wherein the ratio of the powder of the granular ion exchange resin to the mixed powder is not more than 78% by weight.

3. A process according to claim 1, wherein the granular ion exchange resin is made into powder by feeding the first slurry into a casing, revolving a rotating shaft with rotating blades inserted in the casing, and pressing the first slurry against a heated inner wall of the casing by means of the rotating blades.

4. A process according to claim 3, wherein the granular ion exchange resin and the filter aid are made into powder by feeding the first slurry and the second slurry into the casing at the same time.

5. A process according to claim 4, wherein a ratio of the powder of the granular ion exchange resin to the mixed powder is not more than 78% by weight.

6. A process according to claim 4, wherein the pellets are subjected to water-resisting treatment.

7. A process according to claim 1, wherein the filter aid is made into powder by feeding the second slurry into a casing, revolving a rotating shaft with rotating blades inserted in the casing, and pressing the second slurry against a heated inner wall of the casing by means of the rotating blades.

8. A process for treating radioactive wastes, which comprises:

a step of heating a first slurry containing granular ion exchange resin as a radioactive waste generated from a radioactive material-handling facility, thereby making the granular ion exchange resin into powder;

a step of heating a second slurry containing filter aid as a radioactive waste generated from the radioactive material-handling facility, thereby making the filter aid into powder;

a step of heating a radioactive waste solution containing sodium sulfate generated from the radioactive material-handling facility, thereby making the sodium sulfate into powder;

a step of obtaining mixed powder of the powder of the granular ion exchange resin, the powder of the filter aid as a binder, and the powder of the sodium sulfate, the powder of the granular ion exchange resin being present in the mixed powder at a ratio satisfying the following formula:

$$Y \leqq 90 - 21.8\left(\frac{X}{10}\right) + 1.6\left(\frac{X}{10}\right)^2 + 0.44\left(\frac{X}{10}\right)^3 - 0.045\left(\frac{X}{10}\right)^4$$

wherein X is the % by weight of the powder of the sodium sulfate in a mixed powder and Y is the % by weight of powder of the granular ion exchange resin in the mixed powder with the remaining amount of the mixed powder comprising the powder of the filter aid; and a step of shaping the mixed powder into pellets.

9. A process according to claim 8, wherein respective powders of the granular ion exchange resin, the filter aid and the sodium sulfate are individually obtained by individually feeding the first slurry, the second slurry and the radioactive waste solution into a casing, revolving a rotating shaft with rotating blades inserted into the casing, and pressing said radioactive wastes against a heated inner wall of the casing by the rotating blades.

10. A process according to claim 8, wherein respective radioactive wastes are made into powder by feeding the first slurry, the second slurry, and the radioactive waste solution into a casing at the same time, revolving a rotating shaft with rotating blades inserted into the casing, and pressing said respective radioactive wastes against a heated inner wall of the casing by said rotating blades.

11. A process according to claim 10, wherein the pellets are subjected to water-resisting treatment.

* * * * *